United States Patent [19]

Tarrson et al.

[11] Patent Number: 4,907,135

[45] Date of Patent: Mar. 6, 1990

[54] DENTAL MIRROR FLASHLIGHT

[75] Inventors: Emanuel B. Tarrson; Dane Maric; Stevan Tisma, all of Chicago, Ill.

[73] Assignee: John O. Butler Company, Chicago, Ill.

[21] Appl. No.: 192,855

[22] Filed: May 11, 1988

Related U.S. Application Data

[63] Continuation of Ser. No. 833,990, Feb. 27, 1986, abandoned.

[51] Int. Cl.[4] ..... F21V 33/00

[52] U.S. Cl. ..... 362/109; 362/206; 362/138

[58] Field of Search ..... 362/109, 119, 118, 120, 362/202, 204, 203, 205, 206, 804, 208, 157, 158, 135, 138; 200/60; 128/23

[56] References Cited

U.S. PATENT DOCUMENTS

| | | | |
|---|---|---|---|
| 1,955,511 | 4/1934 | Muros | 362/202 |
| 2,107,791 | 2/1938 | Henning | 362/804 |
| 2,302,072 | 11/1942 | Tickell | 362/202 |
| 2,706,769 | 4/1955 | Cook | 362/120 |
| 3,592,199 | 7/1971 | Ostensen | 362/206 |
| 4,515,295 | 5/1985 | Dougherty | 362/191 |
| 4,516,194 | 5/1985 | Johns | 362/206 |
| 4,559,588 | 12/1985 | Engelson et al. | 362/202 |
| 4,722,035 | 1/1988 | Rapisarda | 362/109 |

FOREIGN PATENT DOCUMENTS

| | | | |
|---|---|---|---|
| 1020623 | 11/1952 | France | 362/120 |
| 1109712 | 9/1955 | France | 362/804 |

*Primary Examiner*—Ira S. Lazarus
*Assistant Examiner*—D. M. Cox
*Attorney, Agent, or Firm*—Laff, Whitesel, Conte & Saret

[57] ABSTRACT

A pen light has a removable dental mirror positioned to be in the beam of the light. The flashlight has a barrel which is constricted on one end to capture and hold a pen light bulb dropped in the other end. The electrical circuit within the flashlight includes a strip spring with a bow or arched section which make contact with the base of a flashlight bulb of almost any type and with many different sizes, on a bulb drop-in basis. The electrical contacts are such that the batteries may be dropped either end first into the barrel of the flashlight. The off-on switch has a threaded screw so that the light is switched off and on by turning a screw.

7 Claims, 1 Drawing Sheet

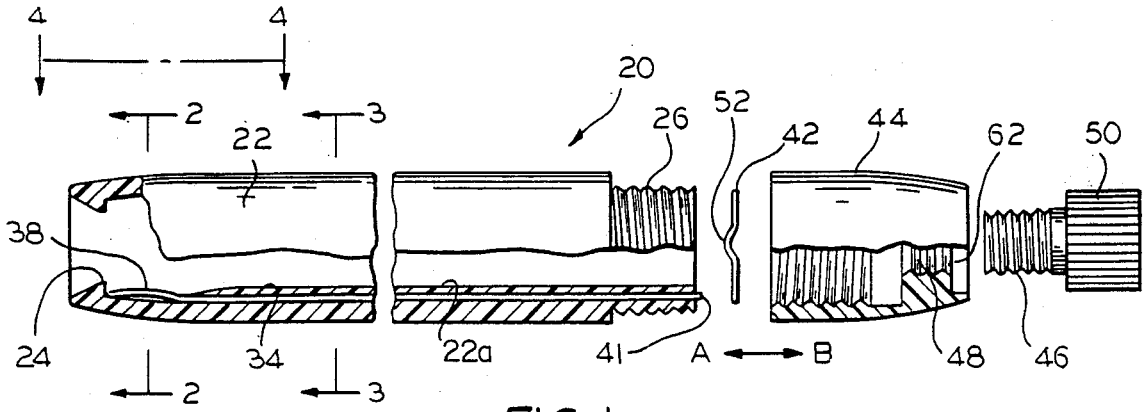
FIG. 1
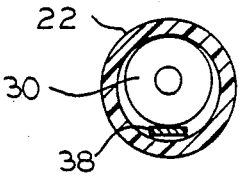
FIG. 2
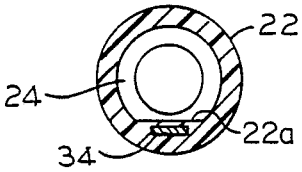
FIG. 3
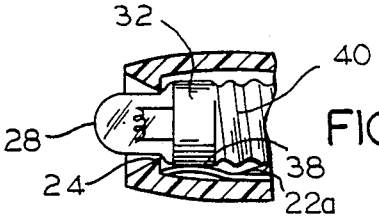
FIG. 4
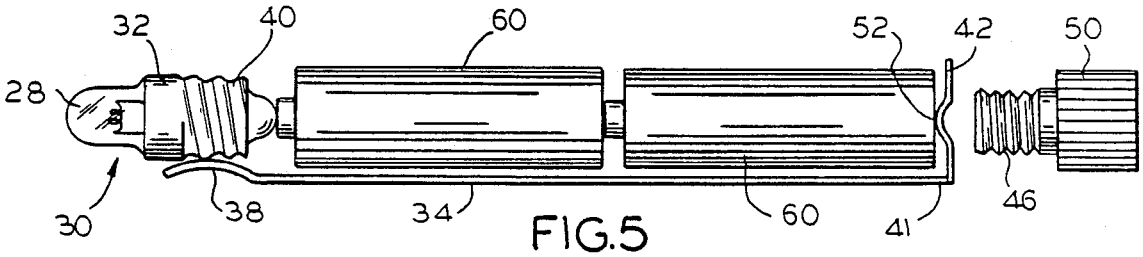
FIG. 5
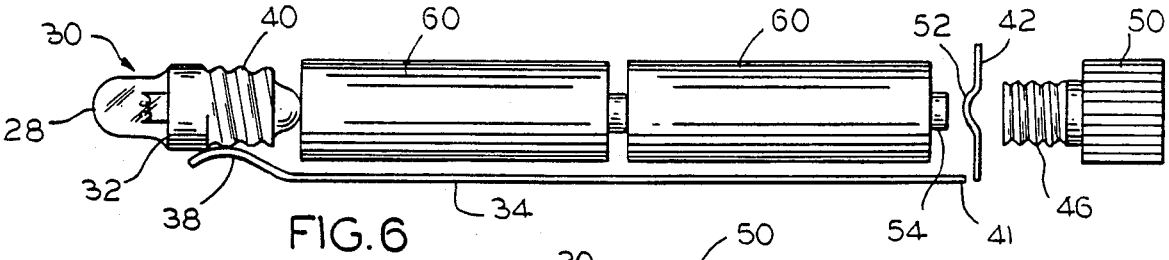
FIG. 6
FIG. 7
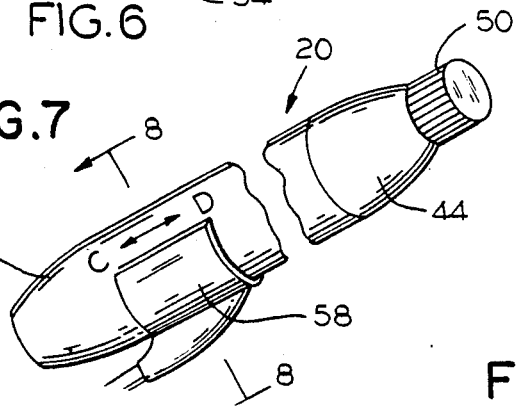
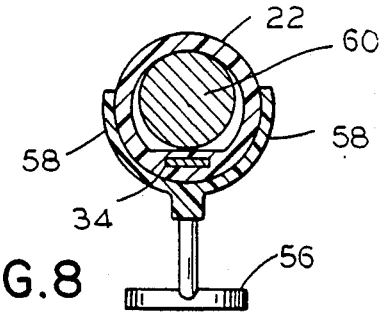
FIG. 8

DENTAL MIRROR FLASHLIGHT

This is a continuation of application Ser. No. 833,990, filed Feb. 27, 1986, now abandoned.

This invention relates to flashlights and, more particularly, to flashlights of the penlight size which are particularly, but not exclusively, well suited for use with dental mirrors.

The inventive flashlight may find any of many different uses; however, it is specifically designed to be used in connection with a dental mirror. This usage imposes a number of constraints not found in other flashlights. The light must be relatively small so that it may be used without introducing a substantial bulk or occupying any more space than a normal dental mirror occupies in and about the mouth, since it may be used along with other dental tools.

The flashlight must be made from a kind of material which may be kept sanitary and safely used in and around the mouth. Of course, it should not be made of any material which may taste bad, leave unwanted chemicals or other residue in the mouth, or the like.

Still another consideration is that the flashlight should be easy to use. For example, the loading or replacement of light bulbs, batteries, etc. should be possible even when a dentist has something else in his hands or is distracted, as by events occurring during an examination. The lamp should remain switched on without requiring the dentist to hold a push button, or to remain off even if something is set down on top of it which might otherwise push a button.

If a flashlight is used in the mouth, it does not have to be as waterproof, as it would have to be if dropped into the water. However, it does have to be water resistant to the extent that small amounts of saliva, a mouthwash, toothpaste, etc. do not adversely affect the operation of the lamp.

For these and other reasons, a dental flashlight tends to have a somewhat stringent specification.

Accordingly, an object of this invention is to provide new and improved flashlights. Here, an object is to provide flashlights which may be used on or in connection with dental mirrors. Still another object of the invention is to provide sanitary flashlights which may be used in and around the mouth.

A further object of the invention is to provide flashlights which may receive almost any size of light bulb, on a drop in basis.

Yet another object of the invention is to provide flashlights that may receive batteries which may be dropped into a housing with either end entering the housing first.

Still another object of the invention is to provide flashlights which may be switched on or off with assurance that it will remain on or off until positively switched back to its other state.

In keeping with an aspect of this invention, these and other objects are accomplished by a flashlight having a barrel, made almost entirely of plastic, and in a general form and size of a penlight. The plastic is one which has been approved for use around foods and in the mouth and which may be cleaned easily. A thin strip of conductive spring material, such as beryllium copper, extends along the inside of the barrel. Preferably, most of the spring is buried within the plastic inside the flashlight barrel. Near a front end of the barrel, the strip spring bows out and into the inside of the barrel to provide a surface for making contact, with adequate pressure, against the side of the base for a flashlight bulb, despite any variations in the sizes of the base of the bulb. On the opposite end, a shortened section of the strip spring is exposed to make or break contact with a screw controlled contact washer.

The contact washer is preferably a disc which has a protrusion in its center to make practically a point contact which is approximately in the exact center of a battery, the protrusion extending along the axis of the barrel. The washer is mounted on the end of an axial screw at the back end of the barrel. When the screw controlling the washer contact is advanced, the washer engages the short end of the strip spring while the protrusion makes contact with the battery to a complete circuit through battery and bulb. The protrusion on the spring washer is a diameter which is small enough to make contact with only the central terminal of the battery when that terminal is next to the washer. Therefore, it is irrelevant which end of the battery is first inserted into the flashlight barrel, as long as all batteries within the barrel face in the same direction.

An embodiment of the invention is shown in the attached drawings, wherein:

FIG. 1 is a partly exploded view in a side elevation, partly broken away to show a longitudinal cross section of the barrel;

FIG. 2 is a transverse cross section of the barrel, with a light bulb in place, taken along line 2—2 of FIG. 1;

FIG. 3 is a transverse cross section of the flashlight barrel taken along line 3—3 of FIG. 1;

FIG. 4 is a longitudinal cross section taken along line 4—4 of FIG. 1 and showing a light bulb in place within a fragment of the flashlight barrel;

FIG. 5 indicates the electrical circuit with the batteries inserted in one direction;

FIG. 6 indicates the electrical circuit with the batteries inserted in an opposite direction;

FIG. 7 is a perspective view of the flashlight with a dental mirror added thereto; and FIG. 8 is a cross sectional view, with battery in place, taken along line 8—8 of FIG. 6.

In FIG. 1, the flashlight 20 has an elongated plastic barrel 22 which terminates on one end at a constricted area in the form of an annular internal step 24 and on the other end in screw threads 26. The annular internal step 24 provides a mechanical bulb holding means, enables the completion of an electrical circuit to the base, and leaves an opening with a diameter which is large enough to pass the reduced diameter end 28 (FIG. 4) of a pen light bulb 30, but which is not large enough to pass the full diameter 32 of the same light bulb.

An elongated conductive strip spring 34 (such as beryllium copper) extends along the length of the interior of the flashlight barrel. At the end of the barrel which receives the bulb, the conductive strip spring 34 bows or arches at 38 and projects into the interior of the barrel to press with sufficient force against the base 40 of the bulb 30 to make a good and reliable electrical contact. The bow or arched spring at 38 provides a substantial advantage since it insures adequate contact pressure despite variations in the dimensions of a bulb base. These bases are not manufactured to very close tolerances; therefore, it is possible for even a single production run to have such a variance of base diameters that quick insert sockets would not necessarily provide sufficient contact pressure on an undersize base, in the absence of such a bow. Another advantage is that a busy dentist sometimes has several different types of light bulbs, such as screw base and bayonet base, for example. The bow at 38 enables any of these types of bulbs to be used, with complete reliability.

The opposite end 41 of the conductive strip spring 34 projects far enough out of the end of the barrel to make a good and reliable electrical contact with a washer contact 42. Along the length of the conductive strip spring 34 which is between bow or arch 38 and end 40, the strip of metal is substantially buried in the plastic as is shown by a plastic layer 22*a* in FIGS. 1, 3, and 4. This prevents the strip 34 from being dislodged by pressure against either the bowed end 38 or the free end 41.

Opposite the bulb, the threaded end 26 of the barrel 22 is closed by a cap 44 having complementary internal threads. The internal diameter of the cap 44 is adequate to enable the washer contact 42 to travel back and forth in the directions A-B. The washer is mounted on the end of a plastic screw 46 which is threaded through a hole 48 in the cap. Therefore, when the screw 46 is turned in one direction, the washer contact 42 makes an electrical connection between the free end 40 of the conductive strip spring 34 and the battery (as shown in FIG. 5). When the screw 46 is turned in an opposite direction, this connection opens, (as shown in FIG. 6). The outer end 50 of screw 46 is knurled to facilitate the turning.

The center of the washer contact 42 has a protrusion 52 lying along the central axis of the battery. This protrusion makes contact with an end of the battery when the screw 46 is turned far enough to close the contact at 40. The diameter of protrusion 52 is small enough to make a reliable contact with either the bottom or the top terminal of the battery, that is, with either the road, flat terminal or the narrow, protruding terminal typically found at the bottom and top ends, respectively, of conventional cylindrical dry cells. Therefore, either end of the battery may be first inserted into the barrel of the flashlight, as is clearly apparent from an inspection and a comparison of FIGS. 5, 6.

FIG. 7 shows a dental mirror 56 attached to the barrel 22 of flashlight 20. The attachment is made by a C-shaped friction clamp 58 which snaps on or off, over the flashlight barrel. The mirror may slide up or down the barrel, in directions C, D.

The operation of the flashlight should now be clear. The end cap 44 is removed. A light bulb 30 of almost any size may be dropped, glass end first, into the barrel. Next, a suitable number (here, two) of batteries 60 are dropped into the barrel 32, with either end entering the barrel first, but also with all batteries facing in the same direction. It should be apparent that a dentist ca drop bulbs and batteries into place quickly and easily, even if he is holding something else in his hands or is otherwise distracted.

Then, the cap 44 is placed over the threaded end 26 of the flashlight. Thereafter, the end 50 is turned and screw 46 is advanced to close the washer contact 42 and thereby turn on the light. Or, the end 50 is turned in an opposite direction to retract the screw 46 and washer contact 42 and thereby turn off the flashlight.

While the flashlight is specifically designed as a dental mirror light, it is a simple matter to snap off the mirror by pulling the open side of the C-shaped clamp 58 off the flashlight barrel. Then, the flashlight may be used as any pen light is used.

While the flashlight is not completely waterproof to the extent that it could be dropped into a body of water, there is a relatively tight fit at the various openings to resist the entry of moisture- Therefore, the flashlight is sufficiently moisture resistant to be used in and around the mouth. Also, the design is such that it can be made completely waterproof by an addition of simple O-rings at annular step 24 at threaded section 26, and in recess 62 (FIG. 1) under the knurled end 50 of screw 46.

Those who are skilled in the art will readily perceive how to further modify the invention. Therefore, the appended claims are to be construed to cover all equivalent structures which fall within the true scope and spirit of the invention.

The invention claimed is:

1. A flashlight comprising an elongated insulative barrel wall with an unbroken surface terminating at one end in an opening surrounded by an internal annular step and terminating at the other end in a threaded section, a conductive strip spring extending internally along the length of said barrel and being embedded and totally enclosed within said barrel wall from an internally bowed section near said internal annular step to a projection at the threaded end of said barrel, an end cap having internal threads which are complentary to said threaded section, a washer contact within said end cap, and a screw extending through said end cap to extend or retract said washer contact, said washer contact having dimensions which enable it to make or break an electrical circuit responsive to a turning of said screw.

2. The flashlight of claim 1 wherein said washer contact is a disc which has a central protrusion that extends inwardly into said barrel to make contact with a battery in said barrel simultaneously with a contact between said washer contact and said projection at said threaded end.

3. The flashlight of claim 2 wherein said protrusion has dimensions of a size and shape which limits its contact to the central terminal of a battery when said battery is inserted bottom end first into said barrel.

4. The flashlight of claim 3 wherein said opening has a size and shape which enables a small diameter end of a pen light bulb to pass therethrough and said internal annular step has dimensions which preclude a larger shoulder on said pen light bulb from a passing therethrough.

5. The flashlight of claim 4 wherein said bowed section of said conductive strip spring is positioned adjacent a base on said pen light bulb when it is in position with said larger shoulder at said annular step.

6. The flashlight of claim 5 and a dental mirror having a handle with said mirror on one end and a C-shaped clamp on the opposite end of said handle, said C-shaped handle having dimensions which snap on or off of and slidably and adjustably engage said barrel.

7. A dental mirror flashlight comprising an elongated insulative barrel wall with an unbroken surface terminating at one end in an opening surrounded by an internal annular step and terminating at the other end in a threaded section, a conductive strip spring extending internally along the length of said barrel and being embedded and totally enclosed within said barrel wall from an internally bowed section near said internal annular step to a projection at the threaded end of said barrel, an end cap having internal threads which are complementary to said threaded section, a washer contact within said end cap, and a screw extending through said end cap to extend or retract said washer contact, said washer contact having dimensions which enable it to make or break an electrical circuit responsive to a turning of said screw, and further comprising a dental mirror having a handle with said mirror at one end and a C-shaped clamp at an opposite end of said handle, said C-shaped clamp snapping onto and frictionally engaging said barrel, said mirror being thereby adjustably and removably attached to said barrel.

* * * * *